United States Patent [19]

Hopkins

[11] Patent Number: 4,773,110

[45] Date of Patent: Sep. 27, 1988

[54] FOAM FINISHING APPARATUS AND METHOD

[75] Inventor: Gregory J. Hopkins, Charlotte, N.C.

[73] Assignee: Dexter Chemical Corporation, Bronx, N.Y.

[21] Appl. No.: 605,871

[22] Filed: May 1, 1984

Related U.S. Application Data

[63] Continuation-in-part of Ser. No. 416,853, Sep. 13, 1982, abandoned.

[51] Int. Cl.[4] ..... D06B 1/08

[52] U.S. Cl. ..... 8/151; 8/158; 8/477; 15/307; 68/200; 118/410; 118/673; 239/590.3; 239/597

[58] Field of Search ..... 68/13 R, 200, 205 R; 239/451, 455, 456, 590, 590.3, 590.5, 597, 541; 15/307, 306 A; 118/410, 411, 673; 8/151, 158, 477

[56] References Cited

U.S. PATENT DOCUMENTS

| | | | |
|---|---|---|---|
| 3,750,428 | 8/1973 | Bruckner | 15/307 X |
| 3,969,780 | 7/1976 | Henderson | 68/205 R X |
| 4,193,762 | 3/1980 | Namboodri | 68/200 X |
| 4,402,200 | 9/1983 | Clifford et al. | 68/200 |

FOREIGN PATENT DOCUMENTS

| | | | |
|---|---|---|---|
| 594415 | 3/1960 | Canada | 239/597 |

*Primary Examiner*—Philip R. Coe

*Attorney, Agent, or Firm*—Curtis, Morris & Safford

[57] ABSTRACT

A system for the uniform distribution and delivery of foam finish to a fabric is disclosed. The system includes a pressure manifold for delivery of foam under pressure to a moving fabric which includes inner and outer concentrically disposed conduits. The inner conduit receives foam under pressure from both ends and has an effluent port along the length thereof supplying foam to the outer conduit. The outer conduit includes a slotted port along the length thereof for delivery of foam under pressure to a moving fabric passing across the slotted port. The pressure manifold may include a sleeve which is adjustably positioned to seal the end portions of the slotted port depending on the width of the fabric being foam finished. The system may include two such pressure manifolds, arranged in parallel crosswise to the moving fabric, to apply foam simultaneously to both sides of the fabric. The foam delivery system may also include a photocell and its associated circuitry to sense the width of the fabric being finished and a pneumatic cylinder mechanically connected to the sleeve and responsive to a signal output from the photocell circuit to adjust the position of the sleeve so that the latter is in close contact with the selvage of the moving fabric.

4 Claims, 5 Drawing Sheets

FOAM FINISHING APPARATUS AND METHOD

BACKGROUND OF THE INVENTION

FIELD OF THE INVENTION

This application is a continuation in part of copending prior application Ser. No. 06/416,853, filed on Sept. 13, 1982, now abandoned, which is herein incorporated by reference.

This invention relates to a system for the uniform delivery and distribution of foam finish to textile fabrics. More specifically, it relates to a method and apparatus for supplying foam to a moving fabric under pressure in an even manner so that consistent, high quality foam-finished fabrics are obtained. Even more specifically, the invention relates to a novel pressure manifold for delivery of foam to a moving fabric and to means for adjustably sealing the outer portions of the manifold depending on the width of the fabric being finished.

In recent years and in particular since the advent of higher energy costs, much research effort has been devoted to the development of fabric-finishing processes which are more energy efficient than conventional finishing processes. In the latter processes, the fabric is immersed in a bath containing the finishing agent and it is thereafter dried and further processed. In conventional processes immersion of the fabric causes absorption of the finishing agent (dyestuff or sizing agent or the like) in the fiber which may result in swelling and distortion and consequent weakening of those fibers. The conventional processes also have the substantial cost disadvantage of requiring substantial energy to remove the solution or dispersion liquid in which the finishing agent is contained.

Foam finishing processes such as are described in U.S. Pat. No. 3,762,860 have received substantial attention and much research effort has been expended in developing such processes as alternatives to the conventional fabric-finishing processes wherein solutions or dispersions are required. The obvious advantage is that substantially less liquid per unit amount of finishing agent need be applied to and then removed from the fabric.

It is known in foam-finishing processes to apply a foam containing the finishing agent to a moving fabric by means of a horizontal pad operation. The foam is supplied via a suitable applicator onto the surface of a moving fabric so as to create a bank of foam on that fabric. In one known technique the foam is supplied just upstream of a doctor blade, the latter causing the foam to accumulate on the fabric in the desired bank.

In another conventional technique the foam is supplied via a suitable applicator to the area between a rotating fabric roller and a closely adjacent rubber nip roller. A bank of foam is formed in the area defined by the fabric and nip rollers, respectively.

There are certain inherent disadvantages in the known methods for applying finishing agents from foams to moving fabrics. One disadvantage is that it is difficult to closely control the exact amount of finishing agent which is applied to the fabric because it is difficult to achieve and maintain a steadystate operation. The controls available to the foam-finishing operator are the height of the bank of foam which is applied and maintained, the density of the foam (or its inverse, known as the blow ratio), the amount of liquid containing finishing agent which is supplied to the foaming apparatus per unit time and the stability of the foam which is created, the latter being essentially a function of the choice and amount of surfactant which is used. The actual rate of absorption of the foam onto the moving fabric is determined by the wetting action of the foam as it contacts the fabric being finished.

Although manipulation of these controls results in satisfactory operation of some processes, the inherent problems in controlling and metering the amount of finishing agent which is applied to the moving fabric often manifests itself in finished goods having varying amounts of finishing agent applied across its surface. This results in off-specification goods. In foam dyeing processes in particular, non-uniformity is visually unacceptable. The non-uniformity may be in part a function of currents set up in the foam bank itself by the moving fabric or by the fabric and nip rollers and may be in further part due to non-uniform delivery of foam across the width of the fabric.

Still another problem of applying foam from a bank is that there is essentially no control over the pressure of the foam application. It is frequently desirable to vary the pressure of the application depending upon the thickness of the fabric to be finished, the wetting characteristic of the fibers, whether or not the fabric is to be finished on both sides and other considerations. Conventional foam finishing techniques do not provide the desired flexibility or control.

A further disadvantage of using a conventional, foam bank type applicator, such as a horizontal pad, in a foam finishing operation is that the fabric must be substantially dry before the foam finish is applied. This is because the absorption of the foam finish applied to the fabric by conventional foam applicators is uncontrollably affected by the moisture content of the fabric before it is finished. In other words, the degree of wetness of the fabric affects the wet pick up of the foam finish. This is evidenced by the bank of foam uncontrollably rising and falling in height as it rolls above the fabric. The reason for the rising and falling action of the foam bank is that the only way the foam can collapse is through absorption by the fabric. The affect on the wet pick up of the fabric due to its moisture content can be such that it causes the foam to rise and leak over the end dams provided on the applicator to retain the foam bank.

When using a conventional foam applicator to finish a fabric which has been dyed and then rinsed, it is necessary in many applications to dry the fabric to essentially 0% moisture content before the finish is applied. The foam, which is absorbed by the fabric, raises the moisture content of the finished fabric to about 20% in a typical foam finishing operation. The fabric is then subjected to a second drying step. Since drying requires theoretically about 1000 BTUs to remove one pound of water from the fabric and more realistically requires 3000 BTUs per pound of water because of losses in commonly used convection type driers, a two step drying process, which is required when using a conventional foam applicator, can have a significiant affect on the cost of foam finishing a fabric.

The problems discussed above are compounded when using conventional foam applicators on tubular knit fabrics. These fabrics are relatively delicate and can be easily pulled and stretched out of shape. For this reason, finish is customarily applied to tubular knit fabrics by immersing the fabric in a bath of finish solution. If foam finish is to be applied to tubular knit fabrics, the typical process is to pass the fabric betwen two conventional foam applicators.

If horizontal pad applicators are used to apply foam to both sides of a fabric, the fabric should pass vertically between them. If the blade-type foam applicators are used, the fabric should pass between them in a horizontal plane. If there are space constraints in using one of these conventional foam applicators, it may be necessary to direct the fabric from one plane of movement to another by guide rollers or the like so that the fabric is properly disposed before the applicator being used. This requirement may add to the mechanical complexity of a foam finishing apparatus and may result in damage to the fabric as it is forced to follow a tortious path through the finishing apparatus.

OBJECTS AND SUMMARY OF THE INVENTION

It is, therefore, an object of this invention to disclose a system for uniformly delivering and distributing foam finish to textile fabrics, including tubular knit fabrics.

It is another object of this invention to provide apparatus for supplying foam to a moving fabric which avoids the problems of the prior art techniques and which delivers foam in a uniform amount per unit time to a moving fabric.

It is a further related object of this invention to provide a foam delivery system which includes a manifold which achieves the uniform distribution of foam across the width and length of a moving fabric.

It is a further and related object of this invention to provide a foam delivery system including a manifold which controls the pressure of the foam being applied to a moving fabric so that the rate of supply of the foam can be closely controlled.

It is a further object of this invention to provide a continuous and automatic system for applying a uniform amount of foam to a moving fabric per unit time so that the incidence of off-specification finished goods will be reduced.

It is further object to control the pressure of the foam application so that fabrics of varying thicknesses and characteristics can be dyed exactly as desired.

It is yet a further and related object of this invention to provide a foam delivery system which takes the guesswork and difficulty out of methods presently in use for foam-finishing fabrics.

It is still a further object of this invention to reduce to an absolute bare minimum the liquid pick-up of the fabric (pounds of water or solvent per pound of fabric) in the foam finishing apparatus in order to limit further processing costs.

It is an additional object of this invention to disclose a method for applying by pressure a foam finish to a moving fabric.

These and other objects of the invention are achieved in a foam delivery system which broadly includes a pressure manifold for supplying foam under pressure to a continuously moving fabric and means for continuously moving fabric across that manifold. The pressure manifold includes at least two conduits, an inner conduit to which foam is supplied under pressure having an effluent port along at least a portion of its length, and an outer conduit, larger than the inner conduit and surrounding the inner conduit, having a slotted port formed along its length for delivery of foam under pressure to the moving fabric. The means for moving the fabric across the pressure manifold may be any conventional system including fabric rolls and the like.

The system may include a pair of pressure manifolds, each having a structure as previously described, to process tubular knit fabrics. The pressure manifolds are arranged in parallel transversely to the moving fabric with the broad side of one adjacent that of the other. The tubular fabric, being in a flattened state, passes between the two manifolds. The outer conduit of each manifold is oriented so that its slotted port is in contact with an outer surface of the fabric. In this way foam can be applied to each side of the fabric simultaneously.

The above and other objects, features and advantages of this invention will be apparent in the following detailed description of illustrative embodiments thereof, which are to be read in connection with the accompanying drawings.

DETAILED DESCRIPTION OF THE PREFERRED EMBODIMENTS

Figure 1:
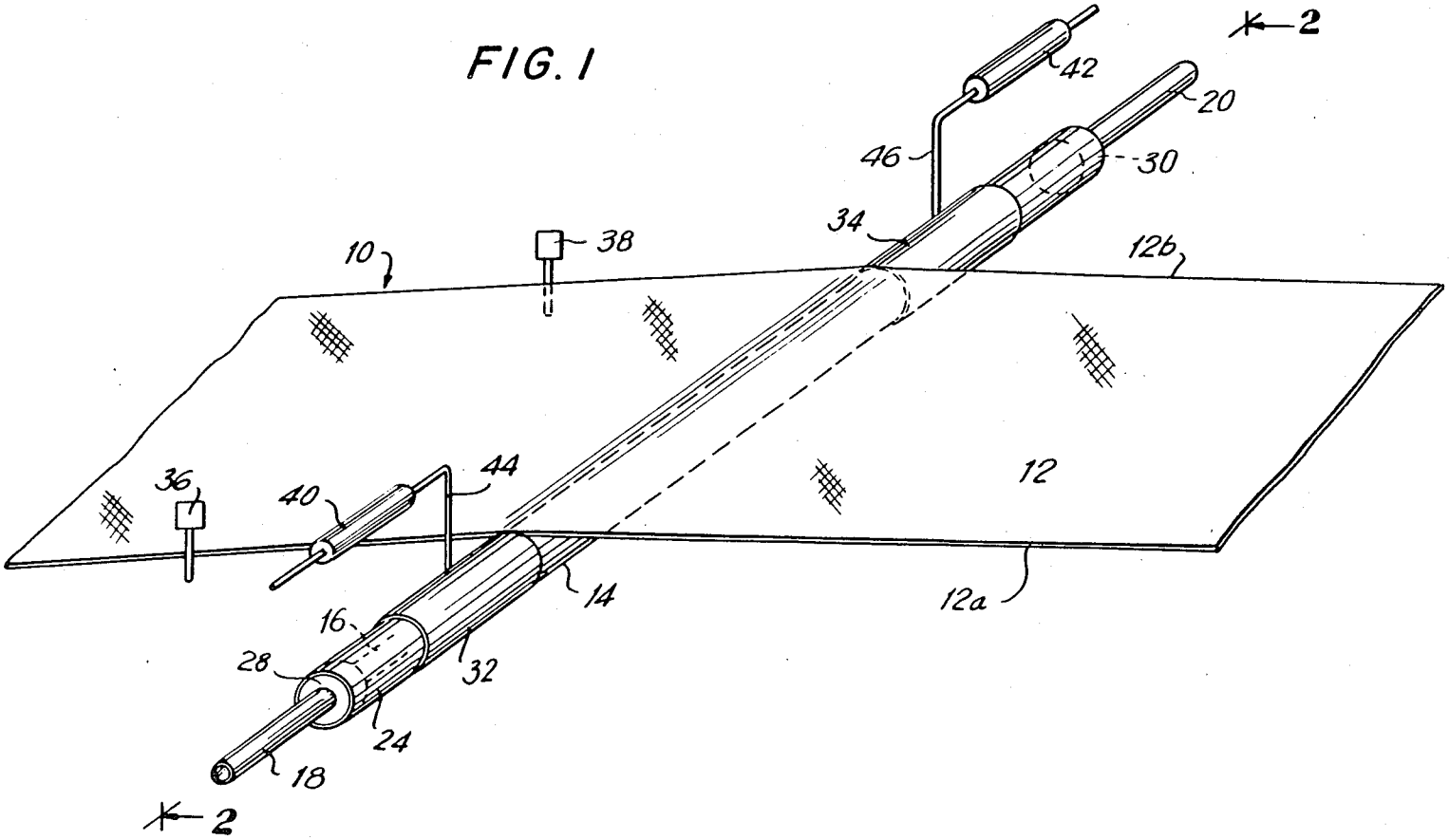
FIG. 1 is a perspective view of the foam delivery apparatus of the invention.
Figure 2:
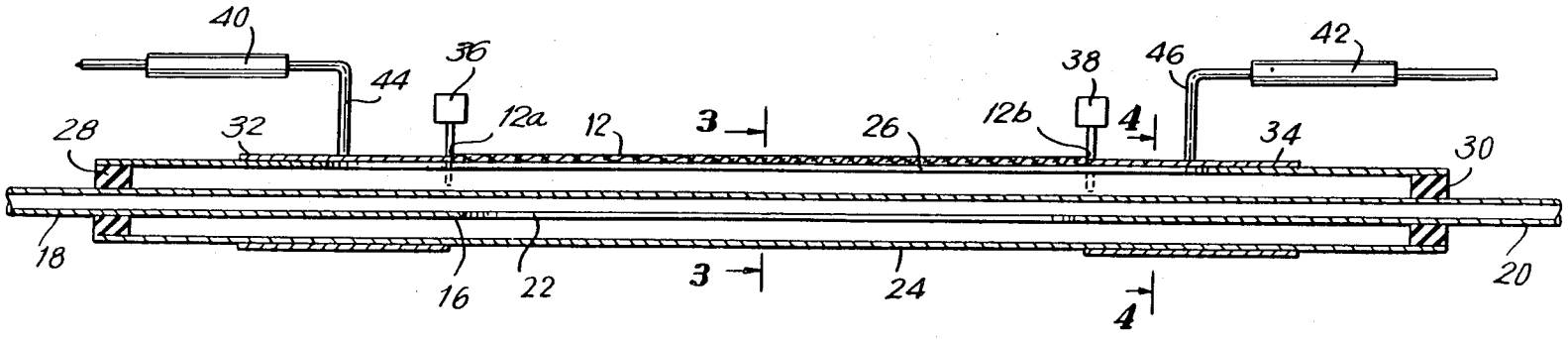
FIG. 2 is a sectional view of the foam manifold of the invention taken along lines 2—2 of FIG. 1.
Figure 4:
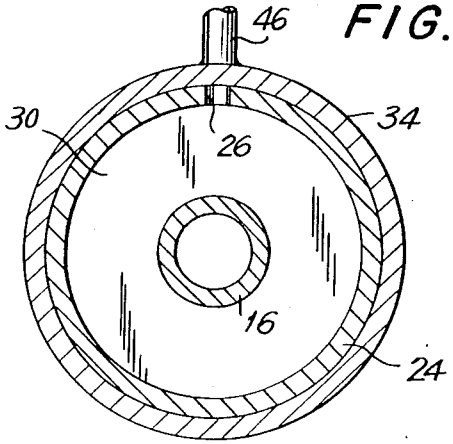
FIG. 4 is a sectional view of the manifold taken along lines 4—4 of FIG. 2.
Figure 3:
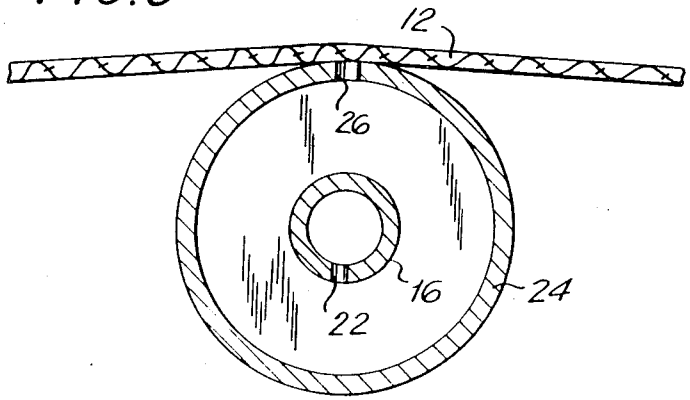
FIG. 3 is a sectional view of the manifold of the invention taken along lines 3—3 of FIG. 2.

Referring now to the drawings in detail and to FIGS. 1 through 4 thereof, reference numeral 10 refers generally to a foam-finishing apparatus according to the invention including a moving band of fabric 12 which passes across a pressure manifold 14. Conventional means such as rollers (not shown) are provided to move fabric 12. Pressure manifold 14 includes an inner conduit 16 to which foam containing a finishing agent is supplied. While foam may be supplied at either end, desirably it is supplied by means of positive displacement pumps from both end 18 and end 20 of inner conduit 16. Conduit 16 may be of any suitable material but preferably is polyvinyl chloride or stainless steel. Inner conduit 16 is provided with an effluent port along the length thereof which is preferably a continuous slot 22 extending along a major portion of the length of conduit 16, as shown in FIG. 1.

Manifold 14 further includes an outer conduit 24 which surrounds and desirably is concentrically disposed with respect to inner conduit 16. Outer conduit 24 is provided with a slotted effluent port 26 which extends along the length of conduit 24 and through which foam is delivered under pressure to moving fabric 12 which passes across slotted port 26.

Outer conduit 24 is sealed at its outer ends by means of fixed, annular, end seals 28 and 30. Inwardly of fixed seals 28 and 30 are adjustable seals 32 and 34 which are sleeves concentrically disposed about outer conduit 24 and movable along the axis of conduit 24. Adjustable seals 32 and 34 prevent flow of foam out of effluent slot 26 in those portions which are sealed off.

For best results the fabric should wrap around the pressure manifold at least a small amount so that it seals the slotted port of the outer conduit 24 and builds up the pressure of the foam inside the manifold. When the pressure of the foam inside the manifold exceeds the sealing force exerted by the fabric, the foam will be forced out of the manifold and will be absorbed at a uniform rate by the moving fabric.

It is preferred if the effluent slot formed in the inner conduit 16 is oriented 180 degrees out of phase with the slotted port formed in the outer conduit 24 although this particular orientation is not necessary for an even distribution of foam. It has been found that as long as the slotted port and the effluent slot are not oriented in the same direction, the foam will be evenly distributed on the fabric.

Foam delivery system 10 further includes palm sensors 36 and 38 which sense the position of the outer edges 12*a* and 12*b*, the selvages, of fabric 12 as it passes towards the foam-finishing manifold 14. Palm sensors 36 and 38, as are well understood in the art, are provided with means for developing a signal which is a function of the position of the edge of the fabric, the signal being relayed to pneumatic cylinders 40 and 42 which are movable in response to such signals to adjust the position of movable seals 32 and 34 by the action of connecting arms 44 and 46.

In a preferred embodiment of the invention the inner conduit 16 may be a $\frac{3}{4}$ inch pipe having an effluent port 22 which is a slot 1/64th inch wide extending along the length of conduit 16. The outer conduit 24 may be a $2\frac{1}{2}$ inch pipe having an effluent port 26 which is a slot 1/8th inch wide along the length thereof. Conduit 24 may be, but need not necessarily be, concentrically disposed with respect to inner conduit 16.

Figure 5:
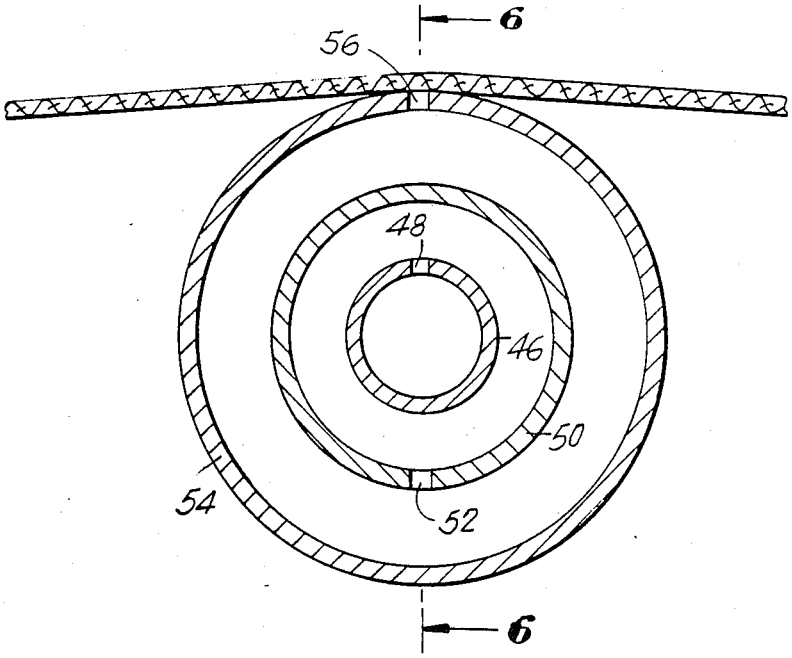
FIG. 5 is a sectional view of the center portion of a second embodiment of the pressure manifold according to the presen invention.
Figure 6:
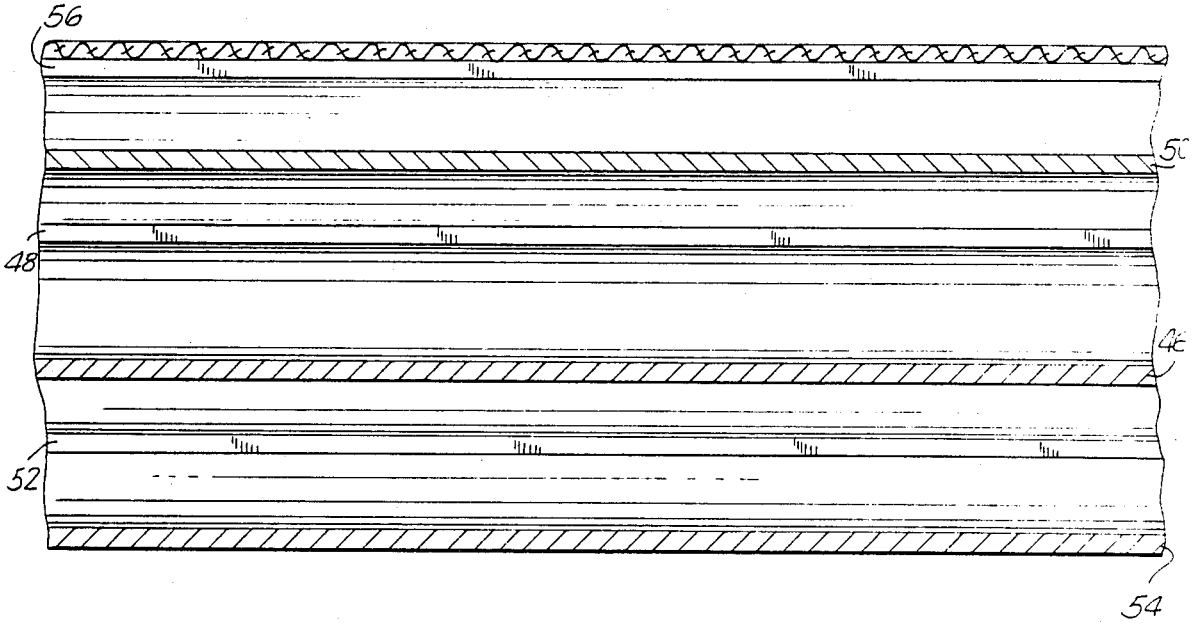
FIG. 6 is a sectional view of the second embodiment shown in FIG. 5 taken along lines 6—6 of FIG. 5.

In foam finishing processes wherein wide fabrics are treated, or where high pressures are required for driving the foam into a thick fabric in order to finish both sides thereof, it is preferable to use a manifold containing three conduits positioned one within the other, as shown in FIGS. 5 and 6 of the drawings. Theoretically, four or more conduits disposed within one another can be used although no further advantage is obtained.

Where three conduits are employed, the inner conduit 46 communicates at both ends with a source of foam under pressure and has an effluent port 48, desirably a slot, along its length. A second conduit 50, larger than the inner conduit 46 is desirably concentrically disposed with respect to the inner conduit and it too has a slotted effluent port 52 along the length thereof. The third conduit 54, desirably concentrically disposed with respect to the other two, has a slotted port 56 along its length for delivery of foam under pressure to a moving fabric.

It has been found that the three-conduit manifold uniformly delivers foam along the width of the fabric because the inner pipes 46, 50 act as restriction orifices supplying foam at high and uniform pressure all along the slotted port 56 of the outer conduit 54. Conversely, it has been found that where one slotted pipe is employed, there is non-uniform flow of foam from a slotted effluent such that less foam is supplied to the center areas. This results in non-uniform application of finishing agent to the fabric and is obviously unsatisfactory.

Figure 7:
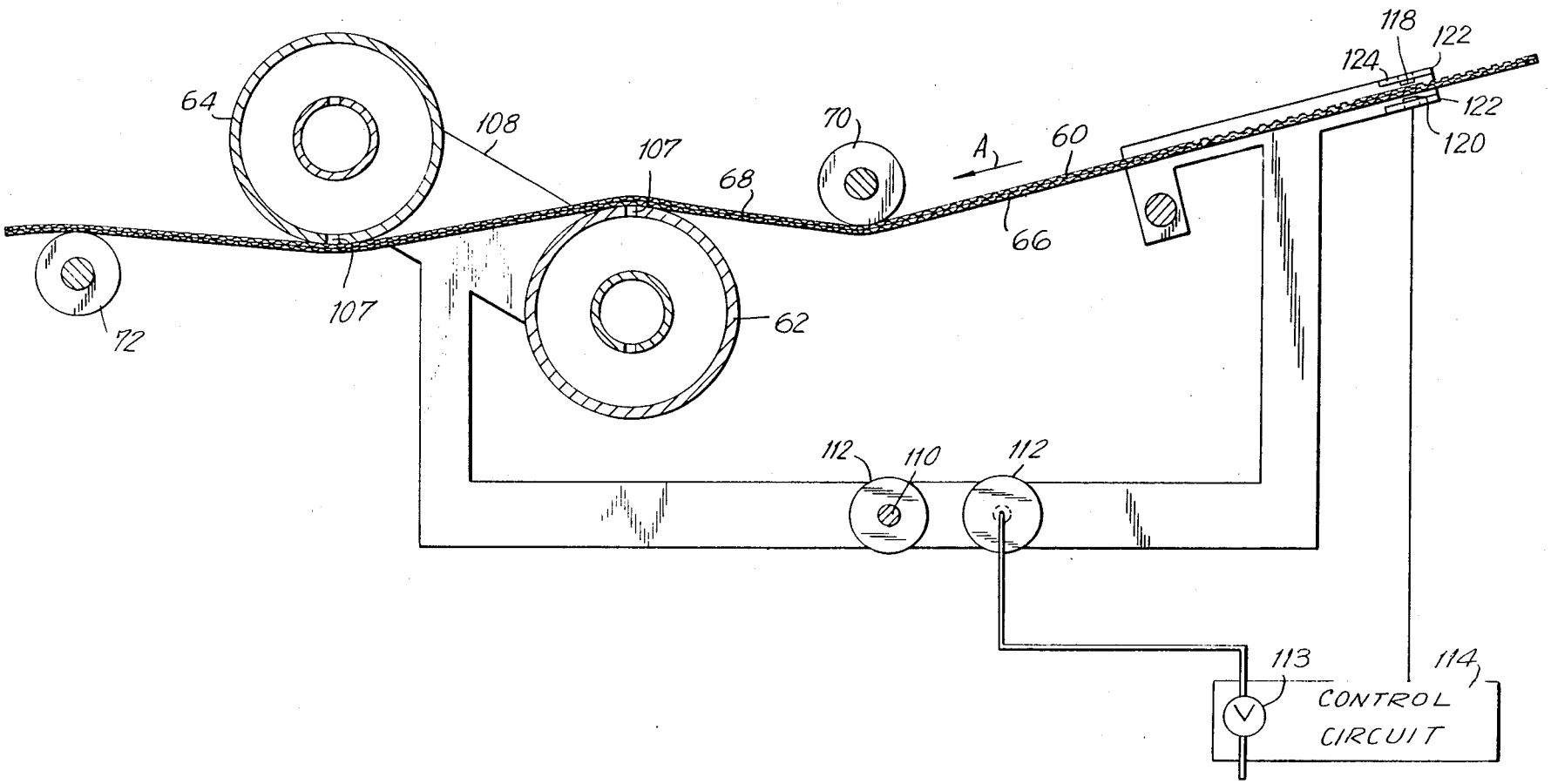
FIG. 7 is a sectional view of a portion of the foam delivery system shown in FIG. 8 taken along lines 7—7 of FIG. 8.
Figure 8:
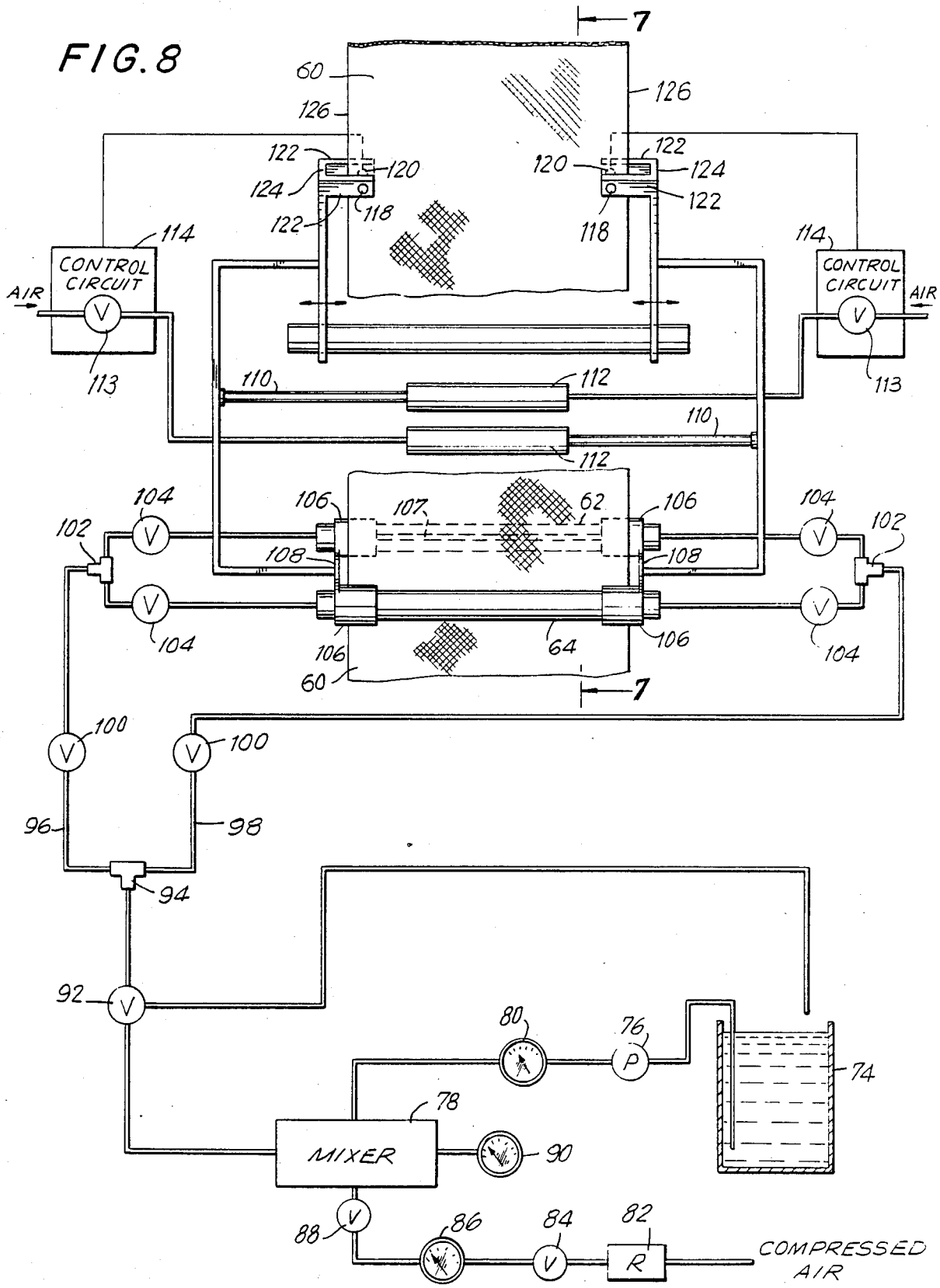
FIG. 8 is a diagrammatical representation of a foam delivery system in accordance with the present invention.

FIGS. 7 and 8 are directed to the foam delivery system of the present invention and more particularly to an embodiment designed to provide a uniform application of foam to each side of a tubular knit fabric. With reference to these figures, it can be seen that a tubular knit fabric 60, which is in a flattened state, can be foam finished by passing it between a pair of first and second horizontally disposed pressure manifolds, 62 and 64 respectively.

The pressure manifolds can have the same structure as those shown in FIGS. 1 through 4 and described previously. They are arranged in parallel crosswise to the moving fabric with the broad side of one adjacent that of the other. The fabric 60, shown in FIG. 7 to be moving in the direction of arrow A, passes over the first pressure manifold 62 and under the second pressure manifold 64, although the reverse will work equally as well. Thus, the first pressure manifold 62 applies foam to the outer surface of the bottom layer 66 of the flattened knit fabric and the second pressure manifold 64 applies foam to the outer surface of the top layer 68 of fabric. The pressure of the foam can be adjusted so that the foam penetrates through to the inner surfaces of the top and bottom layers of fabric.

Although the first and second pressure manifolds 62, 64 are shown in FIGS. 7 and 8 and described herein as being horizontally disposed, the foam finishing apparatus will work just as well with the manifolds disposed in other positions including vertical.

If horizontally disposed manifolds are used, it may be desirable to offset one of the manifolds vertically from the other, as shown in FIG. 7, to minimize the drag created on the tubular knit fabric 60. Of course, even if the manifolds are offset, the fabric should wrap around the manifolds at least partly so that it seals the slotted ports and builds up the pressure of the foam inside the manifolds.

A pre-applicator roller 70 and a post-applicator roller 72 respectively situated before the first pressure manifold 62 and after the second pressure manifold 64 may be provided to help propel the fabric through the foam finishing apparatus. The pre-application and post-application rollers are preferably driven rather than free wheeling to prevent stretching the relatively delicate fabric. Conveyor belts (not shown) may be provided before and after the pressure manifolds to further insure that the fabric is not damaged through overstretching.

The foam delivery system of the present invention illustrated in FIGS. 7 and 8 is designed for tubular knit fabrics, although an analogous arrangement of components shown in the figures which interface with a single pressure manifold as previously described and shown in FIGS. 1 through 6 is envisioned.

FIG. 8 particularly shows the foam delivery system which will now be described in detail. A solution of foam finish is prepared in accordance with the requirements of the job and held in a mix tank 74. A variable speed, positive displacement liquid pump 76 withdraws the finish solution from the mix tank 74 and supplies it to a blender or mixer 78 after passing the liquid through an in-line flow meter 80.

Regulated compressed air is also supplied to the blender 78. If the foam delivery system is to be used in a manufacturing plant, then the compressed air will most likely be tapped from the manufacturing plant's primary source. If this is the case, then an air pressure regulator 82 should be included and adjusted to filter out any fluctuations in air pressure. Selecting a regulator which is adjusted to 10 to 20% below the maximum air pressure of the plant is usually sufficient to supply a constant flow of air to the blender 78. Between the source of compressed air and the blender are the following: the regulator 82, a manual control valve 84, an air flow meter 86 and a variable air flow valve 88 with a fine adjustment.

The blender 78 receives the regulated air and finish solution and whips the two into a foam. The speed of the blender is adjustable and monitored with a gauge 90.

The liquid flow rate, air flow rate and mixer speed are all variable and controllable to give the desired add-on and foam characteristics. The liquid flow rate determines wet pick up, the mixer rate determines bubble size and the air flow rate determines foam volume. The latter two parameters determine, among other things, the evenness of application.

From the blender the foam finish is supplied to an automatic by-pass valve 92. This valve operates in response to a signal from the system which indicates that the fabric driving means has been shut off, perhaps due to a malfunction. The automatic valve will respond to the signal by redirecting the foam finish to the mix tank 74 where it dissolves back into the finish solution.

After the automatic valve 92, the foam finish is directed to flow to a "T" joint 94 where it divides into a first branch 96 and a second branch 98. In line with the first and second branches are variable flow valves 100 which can be manually adjusted to insure that the flow through each branch is equal. After the flow adjust valves 100, the first and second branches 96, 98 are divided by "T" joints 102, the outputs of which are connected through check valves 104 to respective ends of the pressure manifolds 62, 64 previously described.

For purposes of clarity, the pressure manifolds 62, 64 will hereinafter be described as having the same structure as the embodiment shown in FIGS. 1 through 4. The pressure manifolds 62, 64, which are disposed in parallel with the broad side of one adjacent that of the other, include sleeves 106 adjustably mounted to the ends of each for controlling the width of slotted ports 107 formed in the manifolds. Corresponding sleeves 106 on the same side of the pressure manifolds are mechanically ganged together by a bracket 108 and connected to a piston 110 of one of a pair of pneumatic cylinders 112. Pneumatic cylinders 112 which can quickly respond to any changes in the width of the fabric or the position of the fabric edge must be selected.

Pressurized air is supplied to the pneumatic cylinders 112 after passing through respective air pressure control circuits 114. Each control circuit 114 will vary the air pressure supplied to its respective pneumatic cylinder 112 by controlling a valve 113 or similar device in response to a signal supplied to it from a fabric edge sensing circuit 116.

Two fabric edge sensing circuits 116, each of which comprises an incandescent lamp 118 and a photocell 120, are included. The photocell 120 and lamp 118 of each circuit are mounted to the legs 122 of one of two U-shaped brackets 124. Each bracket 124 is positioned by an edge 126 of the fabric 60 with the fabric running between the legs 122 of the bracket 124. In this way, the position of the edge of the fabric can be detected as an interruption in the path of light between the photocell 120 and the lamp 118 mounted on the legs of the brackets. A signal generated by each photocell 120 is supplied to the corresponding air pressure control circuit 114. U-shaped brackets 124 and brackets 108 connecting the manifold sleeves 106 on the same side are joined so that the sleeves 106 and the edge sensing circuits 116 can move in unison in response to the lateral movement or width variations of the fabric 60 as it passes through the foam finishing apparatus.

It has been found that the foam delivery system of the present invention provides great flexibility in applying foam under closely controlled pressure to a variety of fabrics of different charateristics and thicknesses. By using either two- or three-conduit manifolds and by varying the widths of the effluent ports in the inner and outer conduits, it is possible to achieve a measure of positive control over the supply of foam to the fabric that has heretofore not been obtainable. In addition, it has been found that the water pick-up can be as low as 10% or less whereas in prior art foambank techniques the water pick-up is 15% or higher. This results in very substantial savings in further processing and in the energy required to remove the water or other solvent from the finished fabric. This substantial reduction in water pick-up can be attributed to the smaller contact area between the foam and the fabric in the invention as contrasted with the area of contact in the foambank operations of the prior art.

It has also been found that the foam delivered with the manifold and system of the invention is uniformly distributed across both the length and width of the fabric being finished whereas in prior art devices there are non-uniformities due to variations in the pressure of the foam being applied t the fabric.

The pressure manifold of the present invention has the further advantage over conventional bank foam applicators in that it does not become contaminated with dust or dirt suspended in the atmosphere. This is mainly because the pressure manifold is sealed and the foam is applied to the fabric under pressure. This is particularly useful in a textile plant where the air may be heavily contaminated with fabric fibers.

Although illustrative embodiments of the invention have been described herein with reference to the accompanying drawings, it is to be understood that the invention is not limited to those precise embodiments, and that various other changes and modifications may be effected therein by one skilled in the art without departing from the scope or spirit of this invention.

What is claimed is:

1. A foam delivery system for supplying foam under pressure to a moving fabric in a foam finishing apparatus including (1) means for supplying foam under pressure to a pressure manifold, said pressure manifold including (a) an inner conduit communicating at both ends with a source of foam under pressure and having a slotted effluent port along the length of said conduit for passage of said foam; and (b) an outer conduit larger than said inner conduit and surrounding and being concentrically disposed with respect to said inner conduit, said outer conduit having a slotted port extending along the length thereof for delivery of foam under pressure to a moving fabric passing across said slotted port, (2) means for continuously moving a fabric across said slotted port in the outer conduit of said manifold;

(3) means for adjustably sealing the outer portions of said slotted port in the outer conduit;

(4) means for sensing the position of the edges of the fabric furnished to said slotted port including means for developing a signal which is a function of the position of the edges of said fabric; and (5) means responsive to said signal for adjusting said sealing means so that it is in close contact with the selvage of the said fabric.

2. A foam delivery system for supplying foam under pressure to a moving fabric in a foam finishing apparatus including (1) means for supplying foam under pressure to a pressure manifold, said pressure manifold including (a) an inner conduit communicating at at least one end with a source of foam under pressure and having effluent port means along the length thereof for passage of said foam;

(b) a second conduit larger than said inner conduit and surrounding said inner conduit, said outer conduit having effluent port means along the length thereof for passage of said foam; and (c) a third conduit, larger than said second conduit and surrounding said second conduit, said third conduit having a slotted port along the length thereof for delivery of foam under pressure to a fabric moving across said slotted port;

(2) means for continuously moving a fabric across said slotted port in the third conduit of said manifold; (3) means for adjustably sealing the outer portions of said slotted port in the outer conduit;

(4) means for sensing the positions of the edges of the fabric furnished to said slotted port including means for developing a signal which is a function of the position of the edges of said fabric; and (5) means responsive to said signal for continuously adjusting said sealing means so that it is in close contact with the selvage of the said fabric.

3. A foam delivery system for supplying foam under pressure to a moving fabric in a foam finishing apparatus, which includes (a) a pressure manifold having an inner conduit and an outer conduit larger than said inner conduit and surrounding and being concentrically disposed with respect to said inner conduit, said inner conduit having a slotted effluent port formed therein extending along the length of said conduit, at least one end of said inner conduit being open to receive foam under pressure, said outer conduit having a slotted port formed therein which extends along the length thereof for delivery of foam under pressure to a moving fabric passing across said slotted port;

(b) a mixing tank for preparing a finish solution;

(c) a blender connected to the mixing tank by a fluid conduit and to a source of compressed gas for forming the foam finish and for supplying the foam finish under pressure to the open end of said inner conduit;

(d) means for continuously moving a fabric across the slotted port formed in said outer conduit of the manifold;

(e) means for adjustably sealing the outer portions of the slotted port formed in said outer conduit, said adjustable sealing means comprising sleeve members disposed along the outer edges of said outer conduit and being movable along the axis of said outer conduit to adjust the length of the slotted port;

(f) means for sensing the position of the edges of the fabric furnished to said slotted port including means for developing a signal which is a function of the position of the edges of said fabric, said edge position signal developing means being adjustably positioned in proximity to an edge of said fabric and including a source of light and a photocell aligned with said source of light; and (g) means responsive to said signal for adjusting said sealing means so that said sealing means is in close contact with the selvage of said fabric.

4. A method for applying foam under pressure to a moving fabric, including the steps of:

(1) supplying foam under pressure to a pressure manifold, said pressure manifold including (a) an inner conduit communicating at both ends with a source of foam under pressure and having a slotted effluent port extending along the length of said conduit for passage of said foam; and (b) an outer conduit larger than said inner conduit and surrounding and being concentrically disposed with respect to said inner conduit, said outer conduit having a slotted port extending along the length thereof for delivery of foam under pressure to a moving fabric passing across said slotted port;

(2) continuously moving a fabric across the slotted port in the outer conduit of said manifold;

(3) sensing the position of the edges of the fabric furnished to said slotted port including the step of developing a signal which is a function of the position of the edges of said fabric; and (4) adjustably sealing the outer portions of said slotted port in said outer conduit in response to the fabric edge position signal.

* * * * *